US007407245B2

(12) United States Patent
Endo

(10) Patent No.: US 7,407,245 B2
(45) Date of Patent: Aug. 5, 2008

(54) PRINTING APPARATUS, PRINTING METHOD, COMPUTER PROGRAM, AND COMPUTER SYSTEM FOR DETECTING SKEW OF PRINTING MEDIUM

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 250 days.

(21) Appl. No.: 10/491,500

(22) PCT Filed: Feb. 18, 2003

(86) PCT No.: PCT/JP03/01726

§ 371 (c)(1),
(2), (4) Date: Apr. 1, 2004

(87) PCT Pub. No.: WO03/070468

PCT Pub. Date: Aug. 28, 2003

(65) Prior Publication Data

US 2004/0246285 A1 Dec. 9, 2004

(30) Foreign Application Priority Data

Feb. 21, 2002 (JP) ..... 2002-045207

(51) Int. Cl.
*B41J 29/38* (2006.01)
*B41J 29/393* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 5,127,752 | A | 7/1992 | Courtney | |
| 5,397,192 | A | 3/1995 | Khormaee | |
| 6,305,856 | B1 | 10/2001 | Miyazaki | |
| 6,318,839 | B1 * | 11/2001 | Elgee | 347/37 |

FOREIGN PATENT DOCUMENTS

| | | | |
|---|---|---|---|
| JP | 02-255360 | A | 10/1990 |
| JP | 04-022668 | A | 1/1992 |
| JP | 5-138999 | * | 6/1993 |
| JP | 10-291689 | A | 11/1998 |
| JP | 11-116100 | A | 4/1999 |
| JP | 11-170640 | A | 6/1999 |
| JP | 2001-096874 | A | 4/2001 |

* cited by examiner

*Primary Examiner*—Julian D Huffman
(74) *Attorney, Agent, or Firm*—Sughrue Mion, PLLC

(57) ABSTRACT

A printing apparatus, a printing method, a computer program, and a computer system for decreasing ink consumption amount are provided. A printing apparatus comprises a print head being movable in a main scanning direction and printing medium feeding means for feeding a printing medium, and carries out printing on the printing medium by ejecting ink from the print head, wherein a skew of the printing medium is obtained by detecting, at a plurality of points, a leading edge that is fed first among the edges of the printing medium by the printing medium feeding means, and wherein a starting position, an ending position, or both of these for ejecting ink from the print head, which moves in the main scanning direction, is changed according to the skew that has been obtained.

2 Claims, 13 Drawing Sheets

PRINTING APPARATUS, PRINTING METHOD, COMPUTER PROGRAM, AND COMPUTER SYSTEM FOR DETECTING SKEW OF PRINTING MEDIUM

TECHNICAL FIELD

The present invention relates to printing apparatuses, printing methods, computer programs, and computer systems.

BACKGROUND ART

Color inkjet printers, which are typical printing apparatuses, are already well known. The color inkjet printer has an inkjet type print head for discharging ink from nozzles, and is structured to record images, letters, and the like by making ink droplets land onto print paper, which is an example of a printing medium.

Further, the print head is supported on a carriage which is an example of a movable moving member and which is provided with the print head in such a state that a nozzle surface in which the nozzles are formed opposes the print paper, and the print head moves (performs main scanning) in a width direction of the print paper along a guide member and ejects ink in synchronism with the main-scanning.

Further, in recent years, color inkjet printers capable of performing so-called borderless printing in which printing is performed on the whole surface of print paper are gaining popularity for reasons such as that image output results that are the same as photographs can be achieved. With borderless printing, for example, it is possible to perform printing by ejecting ink at the four edges of the print paper with no margins.

When performing borderless printing, since printing is performed on the entire surface of the print paper, it is important that there are no margin portions in the edge portions of the print paper that has been printed. In order to achieve the above, it is effective to use a method in which print data is prepared slightly larger than the print paper, that is, prepared with a certain amount of margin compared to the size of the print paper, and printing is performed on the print paper based on this print data, taking into consideration situations in which the print paper is supplied in a skewed (slanted) manner.

With this method, however, there is a possibility that printing will be conducted on a region other than the print paper, and there may arise a problem that ink is uselessly consumed.

The present invention has been made in view of the above problems, and an object thereof is to provide a printing apparatus, a printing method, a computer program, and a computer system, which decrease ink consumption amount.

DISCLOSURE OF INVENTION

A main invention is a printing apparatus that comprises a print head being movable in a main scanning direction and printing medium feeding means for feeding a printing medium, and that carries out printing on the printing medium by ejecting ink from the print head, wherein a skew of the printing medium is obtained by detecting, at a plurality of points, a leading edge that is fed first among the edges of the printing medium by the printing medium feeding means, and wherein a starting position, an ending position, or both of these for ejecting ink from the print head, which moves in the main scanning direction, is changed according to the skew that has been obtained.

Other features of the present invention will be made clear by the description of the present specification and the accompanying drawings.

Figure 1:
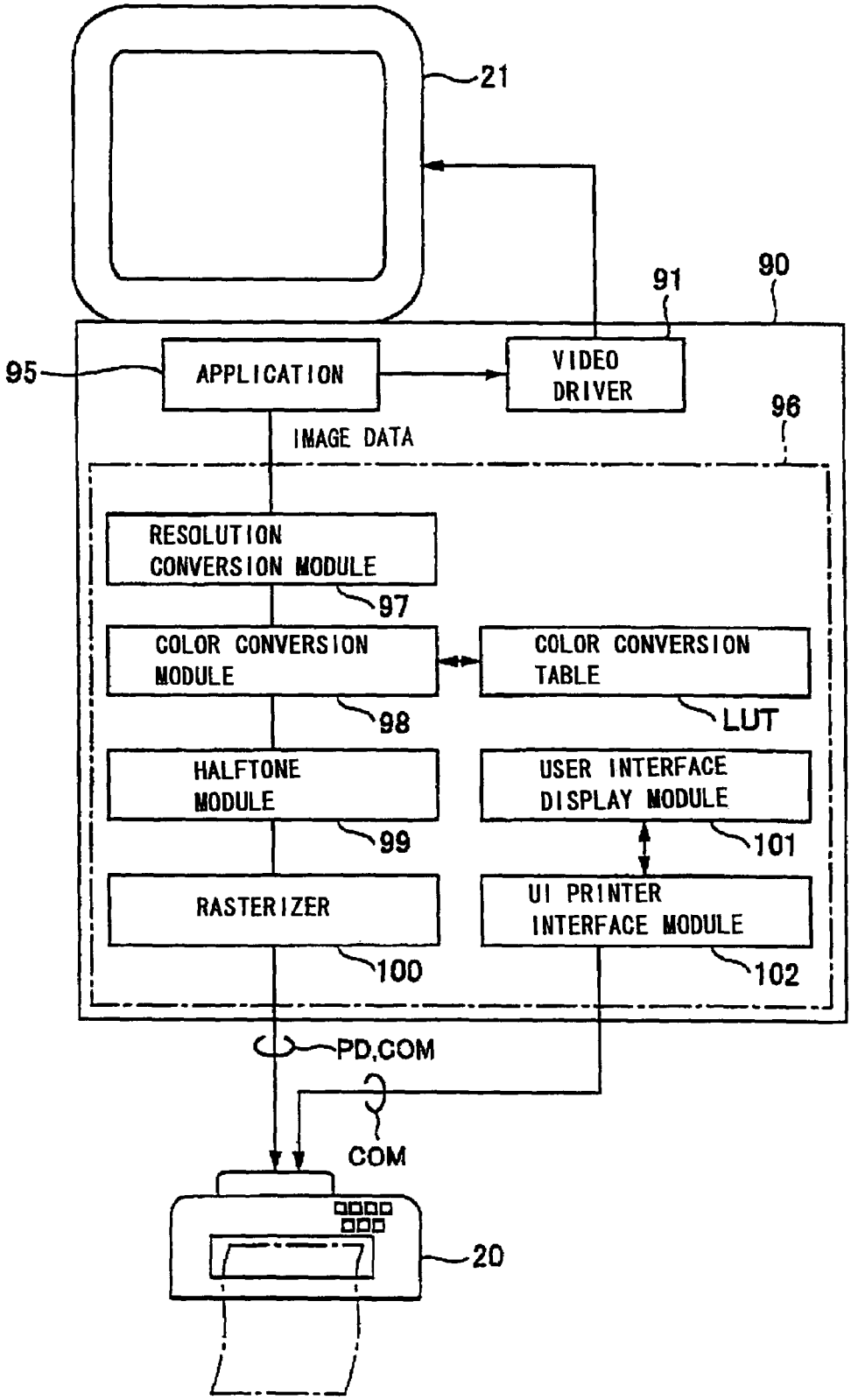
FIG. 1 is a block diagram showing a structure of a printing system as an example of the present invention.

The following is a legend of the numerals mainly used in the drawings:

| | |
|---|---|
| 11 | linear encoder |
| 12 | linear encoder code plate |
| 13 | rotary encoder |
| 14 | rotary encoder code plate |
| 20 | color inkjet printer |
| 21 | CRT |
| 22 | paper stacker |
| 24 | paper feed roller |
| 25 | pulley |
| 26 | platen |
| 28 | carriage |
| 29 | reflective optical sensor |
| 30 | carriage motor |
| 31 | paper feed motor |
| 32 | pull belt |
| 34 | guide rail |
| 36 | print head |
| 38 | light emitting section |
| 40 | light receiving section |
| 50 | buffer memory |
| 52 | image buffer |
| 54 | system controller |
| 56 | main memory |
| 58 | EEPROM |
| 61 | main-scan drive circuit |
| 62 | sub-scan drive circuit |
| 63 | head drive circuit |
| 65 | reflective optical sensor control circuit |
| 66 | electric signal measuring section |
| 90 | computer |
| 91 | video driver |
| 95 | application program |
| 96 | printer driver |
| 97 | resolution conversion module |
| 98 | color conversion module |

-continued

| | |
|---|---|
| 99 | halftone module |
| 100 | rasterizer |
| 101 | user interface display module |
| 102 | UI printer interface module |

BEST MODE FOR CARRYING OUT THE INVENTION

At least the following matters will be made clear by the description of the present specification and the attached drawings.

A printing apparatus for carrying out printing on a printing medium comprises: a print head that is movable in a main scanning direction and that is for ejecting ink onto said printing medium; and printing medium feeding means for feeding said printing medium, wherein a skew of said printing medium is obtained by detecting, at a plurality of points, a leading edge that is fed first among the edges of said printing medium by said printing medium feeding means, and wherein a starting position, an ending position, or both of these for ejecting ink from said print head, which moves in the main scanning direction, is changed according to said skew that has been obtained.

It is possible to decrease the amount of ink consumed by obtaining the skew of said printing medium by detecting, at a plurality of points, a leading edge that is fed first among the edges of said printing medium by said printing medium feeding means, and changing the starting position, the ending position, or both of these for ejecting ink from said print head, which moves in the main scanning direction, according to said skew that has been obtained.

Further, printing may be carried out on an entire surface of said printing medium.

In case of borderless printing, since printing is performed on the end portions of the print paper, the advantages brought about by the above-mentioned means become more significant.

Further, the printing apparatus may comprise light-emitting means for emitting light, and a light-receiving sensor for receiving said light that moves in the main scanning direction according to the movement of said light-emitting means in the main scanning direction, and said skew of said printing medium may be obtained by detecting, for a plurality of times by changing the position of said light-emitting means, a change in an output value of said light-receiving sensor that occurs when said leading edge blocks the light emitted by said light-emitting means that has been positioned.

In this way, it becomes possible to easily determine the position of the leading edge.

Further, the change in said output value that occurs when said leading edge of said printing medium blocks said light may be detected at a first position and a second position that are in positions different from each other in the main scanning direction; and said skew of said printing medium may be obtained based on a distance in the main scanning direction from said first position to said second position, and a feed amount of said printing medium from when the change in said output value is detected at said first position until when the change in said output value is detected at said second position.

In this way, the number of times for detecting the changes in the output value of the light-receiving sensor can be kept at a minimum, and the procedure can be simplified.

Further, the change in said output value of said light-receiving sensor that occurs when said light emitted by said light-emitting means passes across an edge of said printing medium may be detected to determine the position of said edge by making said printing medium stand still and making said light-emitting means move in the main scanning direction; and the starting position, the ending position, or both of these for ejecting ink from said print head, which moves in the main scanning direction, may be changed according to said skew and the position of said edge.

In this way, information for determining an appropriate starting position or an ending position for ejecting ink from the print head, which moves in the main scanning direction, increases, and therefore, an appropriate starting position or ending position can be precisely determined.

Further, the change in said output value of said light-receiving sensor that occurs when said light emitted by said light-emitting means passes across the edge of said printing medium may be detected twice to determine each position of two edges; and said starting position, said ending position, or both of these may be changed according to said skew and the positions of said two edges.

In this way, information for determining an appropriate starting position or an ending position for ejecting ink from the print head, which moves in the main scanning direction, increases, and therefore, an appropriate starting position or ending position can be determined more precisely.

Further, said light-emitting means and said light-receiving sensor may be provided on a moving member that is provided with said print head and that is movable in the main scanning direction.

In this way, there is brought about an advantage that the moving mechanism for the moving member, the light-emitting means, and the light-receiving sensor can be shared.

Further, after detecting the change in said output value of said light-receiving sensor that occurs when said light emitted by said light-emitting means passes across the edge of said printing medium by making said moving member move in the main scanning direction, the starting position, the ending position, or both of these for ejecting ink from said print head, which moves in the main scanning direction, for when said moving member is made to move again in the main scanning direction may be changed according to the detection.

In this way, there is brought about an advantage that it is possible to avoid inconveniences such as having to start ink ejection in beforehand regardless of whether the above-mentioned detection has been. made or not in respect to some of the nozzles of the print head.

Further, a printing apparatus for carrying out printing on an entire surface of a printing medium comprises: a print head that is movable in a main scanning direction and that is for ejecting ink onto said printing medium; and printing medium feeding means for feeding said printing medium; wherein said printing apparatus comprises light-emitting means for emitting light, and a light-receiving sensor for receiving said light that moves in the main scanning direction according to the movement of said light-emitting means in the main scanning direction; wherein said light-emitting means and said light-receiving sensor are provided on a moving member that is provided with said print head and that is movable in the main scanning direction; wherein a change in an output value of said light-receiving sensor that occurs when a leading edge, which is fed first among the edges of said printing medium by said printing medium feeding means, blocks the light emitted by said light-emitting means that has been positioned is detected at a first position and a second position that are in positions different from each other in the main scanning direction; wherein a skew of said printing medium is obtained based on a distance in the main scanning direction from said first position to said second position, and a feed amount of said printing medium from when the change in said output value is detected at said first position until when the change in said output value is detected at said second position; wherein the change in said output value of said light-receiving sensor that occurs when said light emitted by said light-emitting means passes across an edge of said printing medium is detected twice to determine each position of two edges by making said printing medium stand still and making said moving member move in the main scanning direction; and wherein the starting position, the ending position, or both of these for ejecting ink from said print head, which moves in the main scanning direction, for when said moving member is made to move again in the main scanning direction is changed according to said skew and the positions of said two edges.

In this way, since all of the effects described above are achieved, the object of the present invention can be most effectively achieved.

Further, in a printing method conducted by a printing apparatus that comprises a print head being movable in a main scanning direction and printing medium feeding means for feeding a printing medium, and that carries out printing on said printing medium by ejecting ink from said print head, said printing method comprises: a step of obtaining a skew of said printing medium by detecting, at a plurality of points, a leading edge that is fed first among the edges of said printing medium by said printing medium feeding means; and a step of changing a starting position, an ending position, or both of these for ejecting ink from said print head, which moves in the main scanning direction, according to said skew that has been obtained.

It is possible to decrease the amount of ink consumed by obtaining the skew of said printing medium by detecting, at a plurality of points, the leading edge that is fed first among the edges of said printing medium by said printing medium feeding means, and by changing the starting position, the ending position, or both of these for ejecting ink from said print head, which moves in the main scanning direction, according to said skew that has been obtained.

Further, it is possible to realize a computer program that can make a printing apparatus execute the above method which has an effect of being able to decrease the consumption amount of ink.

Further, a computer system comprises: a computer; a display device that is connectable to said computer; and a printing apparatus for carrying out printing on a printing medium, said printing apparatus being connectable to said computer and comprising: a print head that is movable in a main scanning direction and that is for ejecting ink onto said printing medium; and printing medium feeding means for feeding said printing medium, wherein a skew of said printing medium is obtained by detecting, at a plurality of points, a leading edge that is fed first among the edges of said printing medium by said printing medium feeding means, and wherein a starting position, an ending position, or both of these for ejecting ink from said print head, which moves in the main scanning direction, is changed according to said skew that has been obtained.

A computer system realized in this way will be superior to conventional systems as a whole.

===Example of Overall Configuration of the Apparatus===

FIG. 1 is a block diagram showing the configuration of a printing system serving as an example of the present invention. The printing system is provided with a computer 90 and a color inkjet printer 20, which is an example of a printing apparatus. It should be noted that the printing system including the color inkjet printer 20 and the computer 90 can also be broadly referred to as a "printing apparatus." Although not shown in the figure, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD to be transferred to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 levels, for example. The halftone module 99 executes so-called halftone processing to generate halftone image data. The halftone image data are rearranged by the rasterizer 100 into the order in which they are to be transferred to the color inkjet printer 20, and are output as the final print data PD. The print data PD include raster data indicating the state in which dots are formed during each main scan movement, and data indicating the sub-scanning feed amount.

The user interface display module 101 has a function for displaying various types of user interface windows related to printing and a function for receiving input from the user in these windows.

The UI printer interface module 102 has a function as an interface between the user interface (UI) and the color inkjet printer. It interprets instructions given by users through the user interface and sends various commands COM to the color inkjet printer, and conversely, it also interprets commands COM received from the color inkjet printer and executes various displays with respect to the user interface.

It should be noted that the printer driver 96 achieves, for example, a function for sending and receiving various types of commands COM and a function for supplying print data PD to the color inkjet printer 20. A program for realizing the functions of the printer driver 96 is supplied in a format in which it is stored on a computer-readable storage medium. Various kinds of computer-readable media, such as flexible disks, CD-ROMs, magneto optical disks, IC cards, ROM cartridges, punch cards, printed materials on which a code is printed such as a bar code, and internal storage devices (memory such as a RAM or a ROM) and external storage devices of the computer can be used. The computer program can also be downloaded onto the computer 90 via the Internet.

Figure 2:
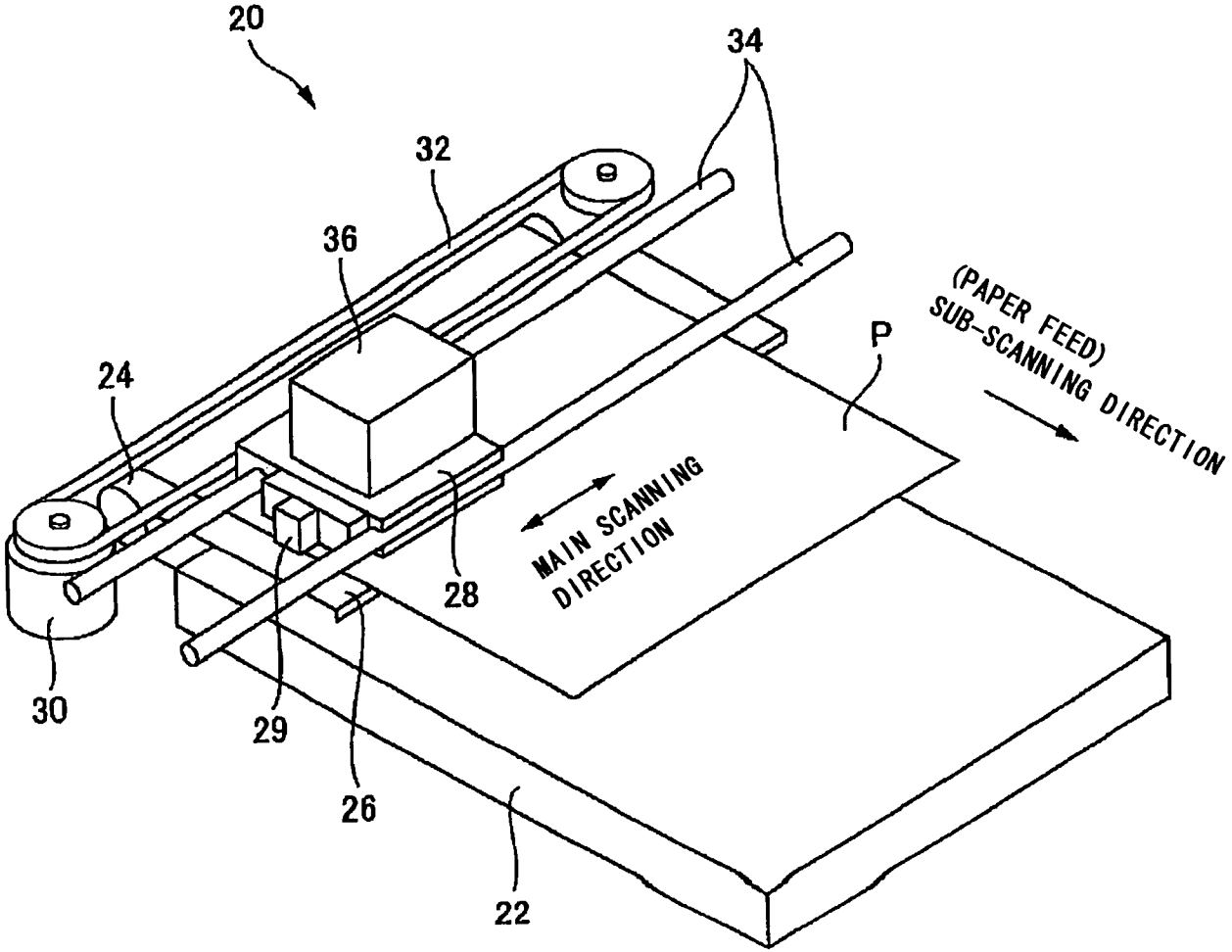
FIG. 2 is a schematic perspective view showing an example of main structures of a color inkjet printer 20.

FIG. 2 is a schematic perspective view showing an example of the main structures of the color inkjet printer 20. The color inkjet printer 20 is provided with a paper stacker 22, a paper feed roller 24 driven by a step motor that is not shown, a platen 26, a carriage 28 serving as an example of a movable moving member that has a print head for forming dots, a carriage motor 30, a pull belt 32 that is driven by the carriage motor 30, and guide rails 34 for the carriage 28. A print head 36 provided with numerous nozzles and a reflective optical sensor 29 that will be described in detail later are mounted onto the carriage 28.

The print paper P is rolled out from the paper stacker 22 by the paper feed roller 24 and fed in a paper feed direction (hereinafter also referred to as the sub-scanning direction) over the surface of the platen 26. The carriage 28 is pulled by the pull belt 32, which is driven by the carriage motor 30, and moves in the main-scanning direction along the guide rails 34. It should be noted that as shown in the diagram, the main scanning direction refers to the two directions perpendicular to the sub-scanning direction. The paper feed roller 24 is also used to carry out the paper-supply operation for supplying the print paper P to the color inkjet printer 20 and the paper discharge operation for discharging the print paper P from the color inkjet printer 20.

===Example of Configuration of the Reflective Optical Sensor===

Figure 3:
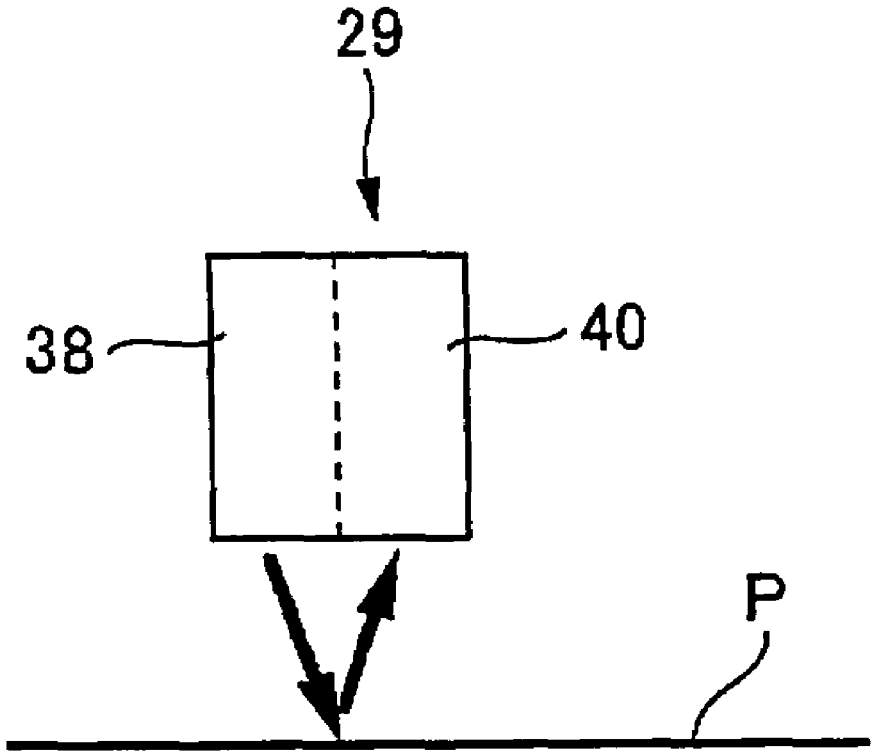
FIG. 3 is a schematic diagram for illustrating an example of a reflective optical sensor 29.

FIG. 3 is a schematic diagram for describing an example of the reflective optical sensor 29. The reflective optical sensor 29 is attached to the carriage 28, and has a light emitting section 38, which is for example made of a light emitting diode and is an example of light-emitting means, and a light receiving section 40, which is for example made of a phototransistor and is an example of a light-receiving sensor. The light that is emitted from the light emitting section 38, that is, the incident light, is reflected by print paper P or by the platen 26 if there is no print paper P in the direction of the emitted light. The light that is reflected is received by the light receiving section 40 and is converted into an electric signal. Then, the magnitude of the electric signal is measured as the output value of the light-receiving sensor corresponding to the intensity of the reflected light that is received.

It should be noted that in the above description, as shown in the figure, the light emitting section 38 and the light receiving section 40 are provided as a single unit and together constitute a device called the reflective optical sensor 29. However, they may also constitute separate devices, such as a light emitting device and a light receiving device.

Further, in the above description, the reflected light was converted into an electric signal and then the magnitude of that electric signal was measured in order to obtain the intensity of the reflected light that is received. However, this is not a limitation, and it is only necessary that the output value of the light-receiving sensor corresponding to the intensity of the received reflected light can be measured.

===Example of Configuration of the Periphery of the Carriage===

Figure 4:
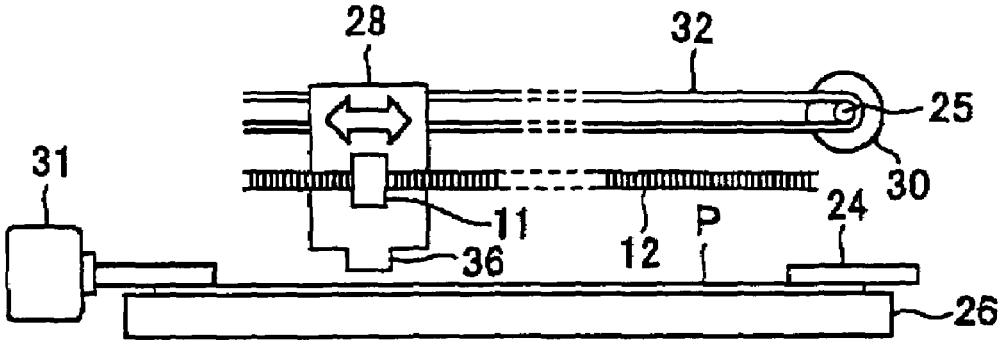
FIG. 4 is a diagram showing a structure of the periphery of a carriage 28 of the inkjet printer.

The configuration of the periphery of the carriage is described next. FIG. 4 is a diagram showing the configuration of the periphery of the carriage 28 of the inkjet printer.

The inkjet printer shown in FIG. 4 is provided with a paper feed motor (hereinafter referred to as a PF motor) 31, which is for feeding paper and which is as an example of the printing medium feeding means, the carriage 28 to which the print head 36 for ejecting ink onto the print paper P is fastened and which is driven in the main-scanning direction, the carriage motor (hereinafter referred to as a CR motor) 30 for driving the carriage 28, a linear encoder 11 that is fastened to the carriage 28, a linear encoder code plate 12 in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25.

Figure 5:
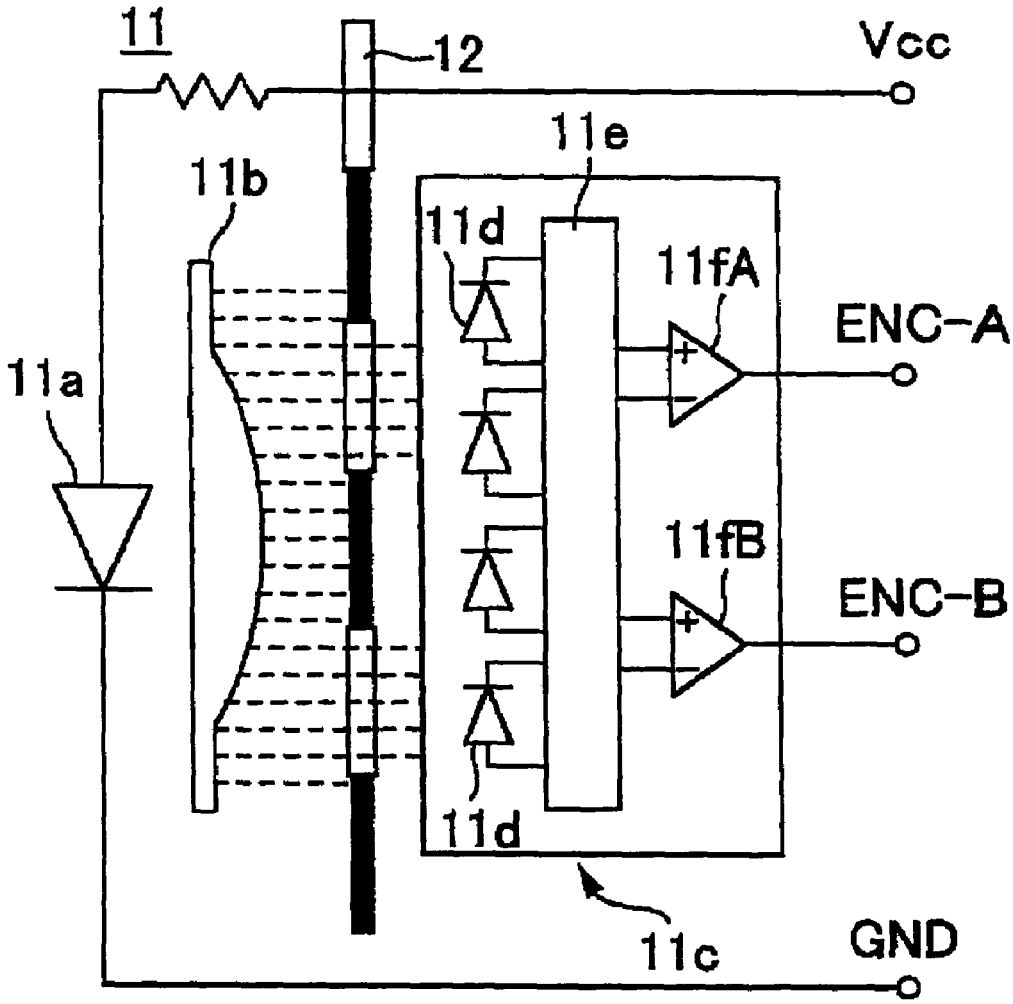
FIG. 5 is an explanatory diagram schematically showing a structure of a linear encoder 11 mounted on the carriage 28.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens lib, and a detection processing section 11*c*. The detection processing section 11*c* has a plurality of (for example, four) photodiodes 11*d*, a signal processing circuit 11*e*, and, for example, two comparators 11*f*A and 11*f*B.

The light-emitting diode 11*a* emits light when a voltage VCC is applied to it via resistors on both sides. This light is condensed into parallel light by the collimating lens 11*b* and passes through the linear encoder code plate 12. The linear encoder code plate 12 is provided with slits at a predetermined spacing (for example, 1/180 inch (one inch=2.54 cm)).

The parallel light that has passed through the linear encoder code plate 12 then passes through stationary slits, which are not shown, and is incident on the photodiodes lid, where it is converted into electric signals. The electric signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulses ENC-A and ENC-B that are output from the comparators 11*f*A and 11*f*B become the output of the linear encoder 11.

Figure 6:
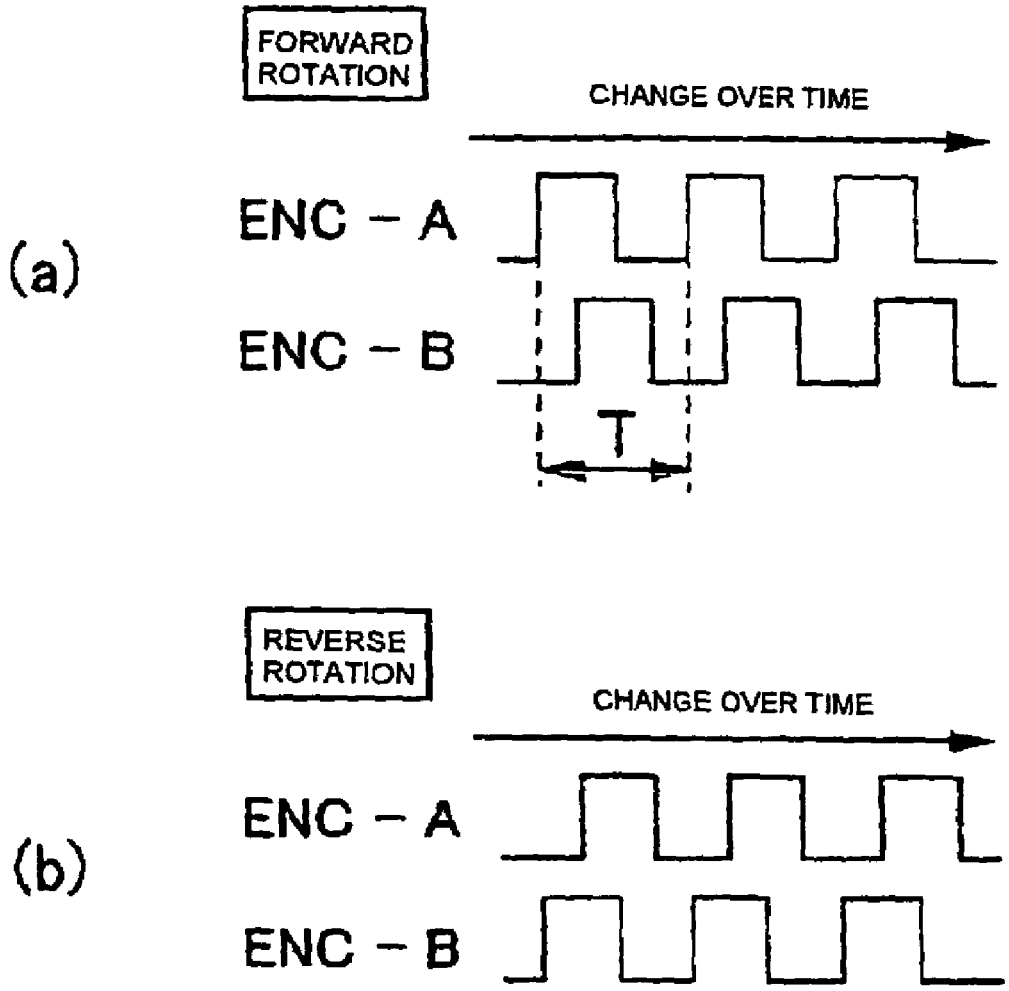
FIG. 6 is a timing chart showing waveforms of two output signals of the linear encoder 11 when a CR motor is rotating forward and when it is rotating in reverse.

FIG. 6 is a timing chart showing waveforms of two output signals of the linear encoder 11 when the CR motor is rotating forward and when it is rotating in reverse.

As shown in FIG. 6(*a*) and FIG. 6(*b*), the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6(*a*), the phase of the pulse ENC-A leads the phase of the pulse ENC-B by 90 degrees. On the other hand, when the CR motor 30 is rotating in reverse, then, as shown in FIG. 6(*b*), the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the linear encoder code plate 12.

Then, the rising edge and the rising edge of the output pulses ENC-A and ENC-B of the linear encoder 11 are detected, and the number of detected edges is counted. The rotational position of the CR motor 30 is obtained based on the number that is calculated. With respect to the calculation, when the CR motor 30 is rotating forward, a "+1" is added every time an edge is detected, and when the CR motor 30 is rotating in reverse, a "−1" is added every time an edge is detected. Each period of the pulses ENC-A and ENC-B is equal to the time from when one slit of the linear encoder code plate 12 passes through the linear encoder 11 to when the next slit passes through the linear encoder 11, and the phases of the pulse ENC-A and the pulse ENC-B are misaligned by 90 degrees. Accordingly, a count value "1" in the above-described calculation corresponds to ¼ of the slit spacing of the linear encoder code plate 12. Therefore, if the count value is multiplied by ¼ of the slit spacing, then the amount that the CR motor 30 has moved from the rotational position corresponding to the count value "0" can be obtained based on this product. The resolution of the linear encoder 11 at this time is ¼ the slit spacing of the linear encoder code plate 12.

On the other hand, the rotary encoder 13 for the PF motor 31 has the same configuration as the linear encoder 11, except that the rotary encoder code plate 14 is a rotation disk that rotates in conjunction with rotation of the PF motor 31. The rotary encoder 13 outputs two output pulses ENC-A and ENC-B, and based on this output the amount of movement of the PF motor 31 can be obtained.

===Example of Electric Configuration of the Color Inkjet Printer===

Figure 7:
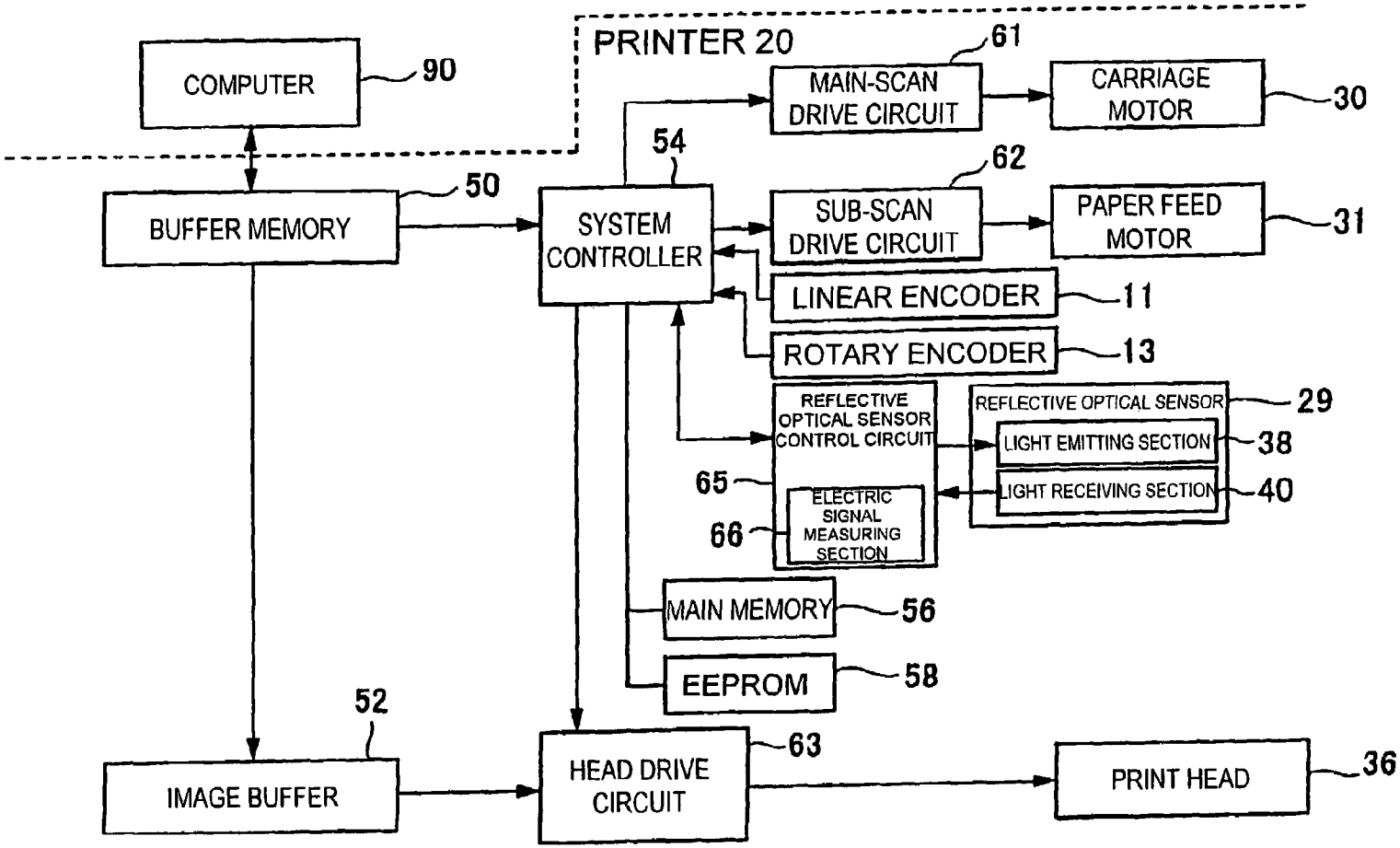
FIG. 7 is a block diagram showing an example of an electric structure of the color inkjet printer 20.

FIG. 7 is a block diagram showing an example of the electric configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light emitting section 38 and the light receiving section 40 of the reflective optical sensor 29, the above-described linear encoder 11, and the above-described rotary encoder 13. Also, the reflective optical sensor control circuit 65 is provided with an electric signal measuring section 66 for measuring the electric signals that are converted from the reflected light received by the light receiving section 40.

The print data that are transferred from the computer 90 are temporarily held in the buffer memory 50. In the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of each color components from the image buffer 52 in accordance with the control signals from the system controller 54, and drives the nozzle arrays for each color provided in the print head 36 in correspondence with the print data.

===Example of Nozzle Arrangement of the Print Head===

Figure 8:
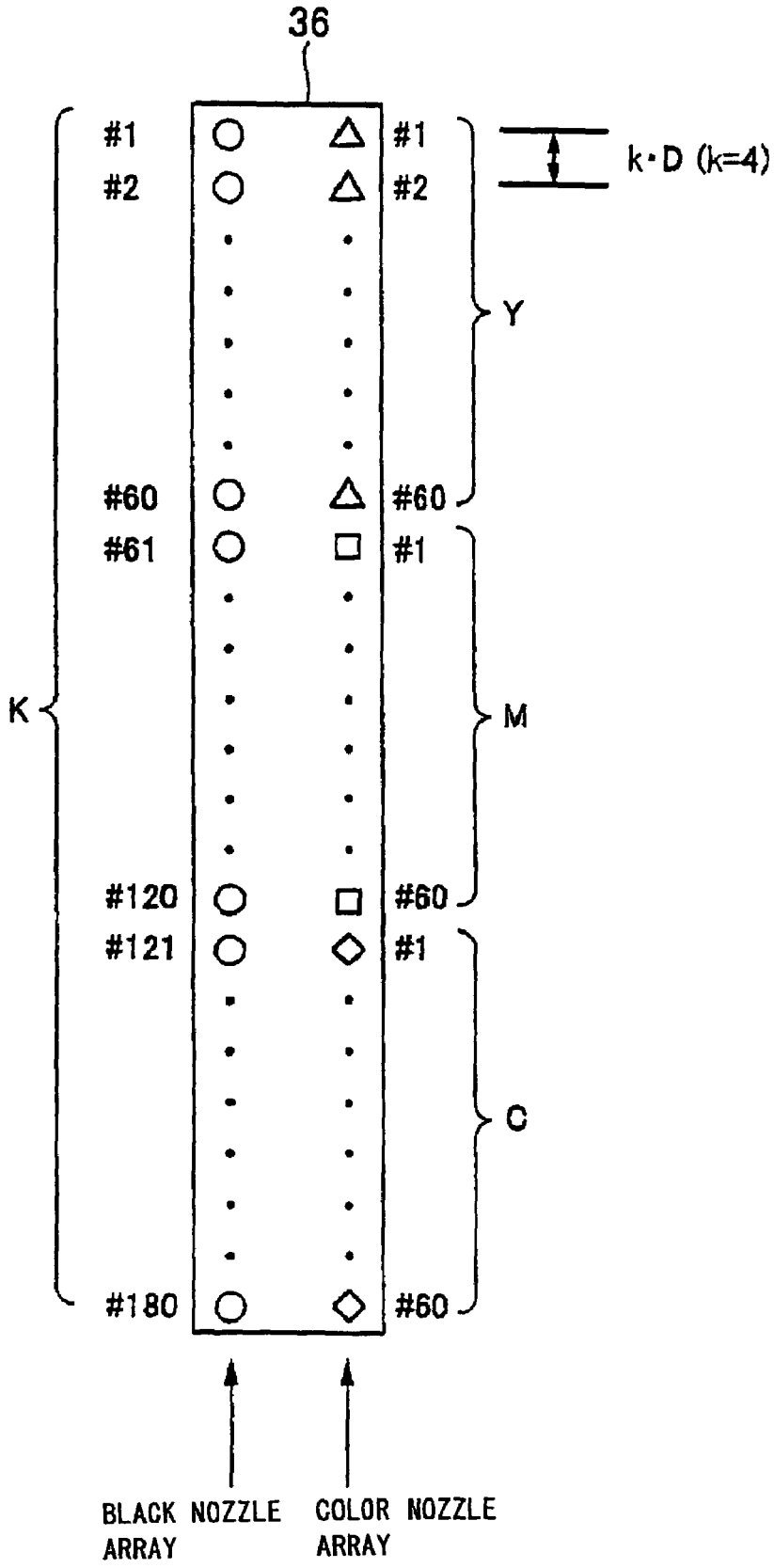
FIG. 8 is an explanatory diagram showing a nozzle arrangement on a lower surface of a print head 36.

FIG. 8 is an explanatory diagram showing the nozzle arrangement in a lower surface of the print head 36. The print head 36 has a black nozzle array and a color nozzle array, each arranged in a straight line along the sub-scanning direction. In this specification, a "nozzle array" is referred to also as a "nozzle group".

The black nozzle array (shown by white circles) has 180 nozzles #1 to #180. These nozzles #1 to #180 are arranged at a predetermined nozzle pitch k-D along the sub-scanning direction. Here, D is the dot pitch in the sub-scanning direction, and k is an integer. The dot pitch D in the sub-scanning direction is equal to the pitch of main scanning lines (raster lines). Hereinbelow, the integer k for indicating the nozzle pitch k-D is referred to simply as the "nozzle pitch k". The unit of the nozzle pitch k is in "dots", and this refers to the dot pitch in the sub-scanning direction.

In the example of FIG. 8, the nozzle pitch k is four dots. However, the nozzle pitch k may be set to be any integer.

The color nozzle array includes a yellow nozzle group Y (shown by white triangles), a magenta nozzle group M (shown by white squares), and a cyan nozzle group C (shown by white rhombuses). Note that, in this specification, the nozzle group for chromatic color ink is also referred to as "chromatic color nozzle group". Each chromatic color nozzle group has 60 nozzles #1 to #60. Further, the nozzle pitch of the chromatic color nozzle group is the same as the nozzle pitch k of the black nozzle array. The nozzle of the chromatic color nozzle group is arranged in the same sub-scanning position as the nozzles of the black nozzle array.

At the time of printing, ink droplets are ejected from each nozzle while the print head 36 is moving with the carriage 28 at a constant speed in the main scanning direction. However, depending on the print mode, not all nozzles are always used, and there is also a case where only some nozzles are used.

FIRST EMBODIMENT

Figure 9:
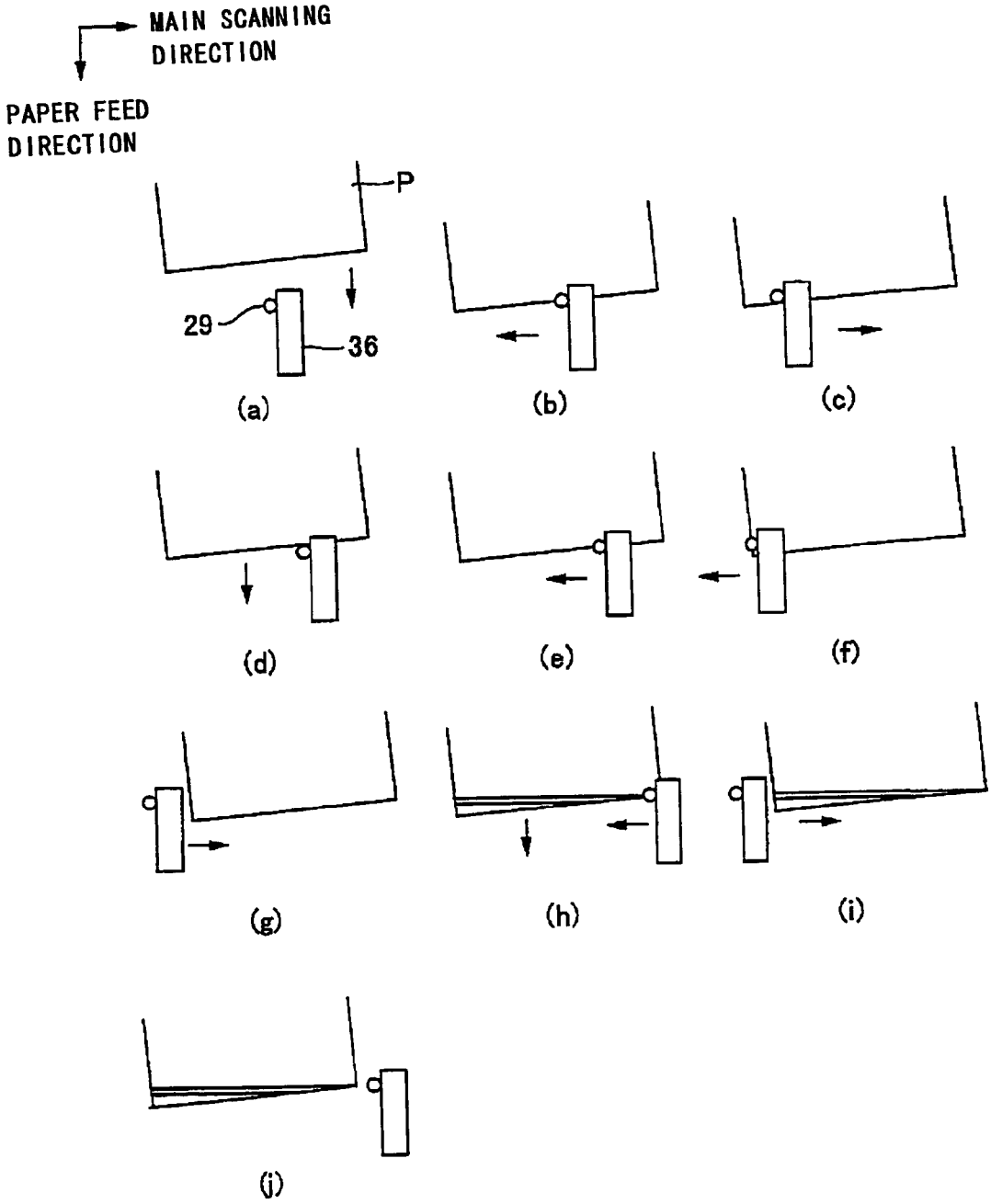
FIG. 9 is a diagram schematically showing a positional relationship of the print head 36, the reflective optical sensor 29, and print paper P.
Figure 10:
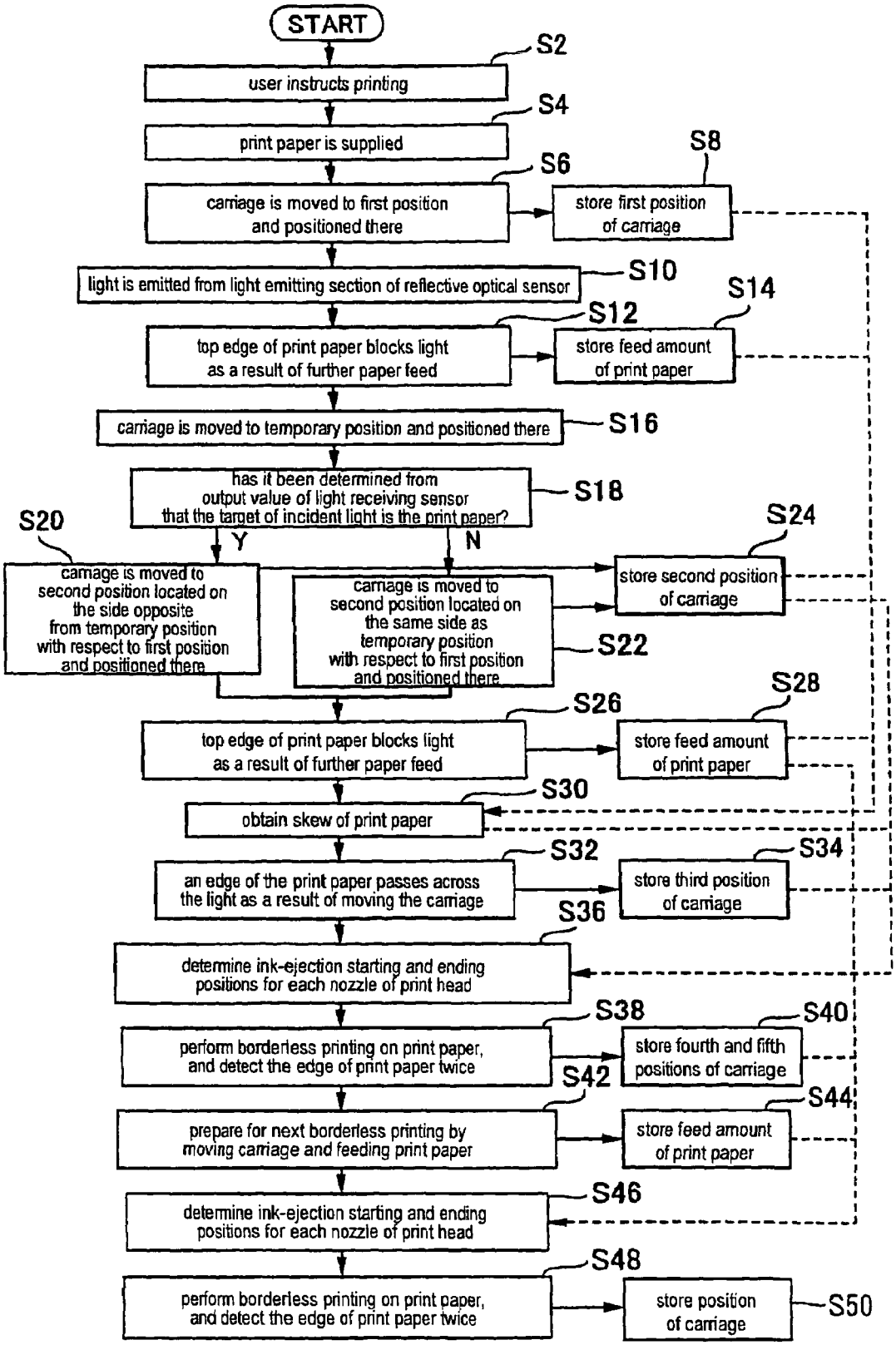
FIG. 10 is a flowchart for illustrating a first embodiment.

Next, using FIG. 9 and FIG. 10, a first embodiment of the present invention is described. FIG. 9 is a diagram schematically showing positional relationships of the print head 36, the reflective optical sensor 29, and the print paper P. FIG. 10 is a flowchart for explaining the first embodiment.

First, the user instructs printing through the application program 95 and the like (step S2). When the application program 95 which has received this instruction issues a print order, the printer driver 96 of the computer 90 receives image data from the application program 95, and converts this data into print data PD which includes raster data that indicates the state in which dots are to be formed in each main scanning and data that indicates a sub-scanning feed amount. Further, the printer driver 96 supplies the print data PD together with various commands COM to the color inkjet printer 20. After the color inkjet printer 20 receives these data with the buffer memory 50, these data are sent to the image buffer 52 or the system controller 54.

Further, the user may give instructions to the user interface display module 101 about the size of the print paper P or that borderless printing is to be performed. The instruction by the user is received by the user interface display module 101, and sent to the UI printer interface module 102. The UI printer interface module 102 interprets the instructed order, and sends a command COM to the color inkjet printer 20. After the color inkjet printer 20 receives the command COM with the buffer memory 50, it sends the command to the system controller 54.

The color inkjet printer 20, for example, drives the paper feed motor 31 by the sub-scan drive circuit 62 based on an order sent to the system controller 54 to supply the print paper P (step S4).

Next, the system controller 54 makes the main-scan drive circuit 61 drive the CR motor 30 to move the carriage 28 to a predetermined position (hereinbelow, also referred to as a first position), and the carriage is positioned there (step S6). Then, the amount of movement of the CR motor 30 from its reference position is obtained based on the output pulses of the linear encoder 11, and the amount of movement, that is, the first position of the carriage 28 is recorded (step S8).

Further, the system controller 54 controls the reflective optical sensor 29 provided on the carriage 28, which has been placed in position, using the reflective optical sensor control circuit 65, and the light emitting section 38 of the reflective optical sensor 29 emits light towards the platen 26 (step S10).

As shown in FIG. 9(*a*) and FIG. 9(*b*), as the print paper P is further fed by the paper feed motor 31, the leading edge (hereinafter, also referred to as the top edge), which is first sent by the paper feed motor 31 among the edges of the print paper P, then blocks the light emitted from the above light emitting section 38 (step S12), as shown in FIG. 9(*b*). At this time, the target of the incident light emitted by the light emitting section 38 changes from the platen 26 to the print paper P, and therefore, the intensity of the electric signal which is the output value of the light receiving section 40 of the reflective optical sensor 29, which received the reflected light, changes. Then, the intensity of the electric signal is measured by the electric signal measuring section 66, and it is detected that the top edge of the print paper P has passed the light.

Further, at this time, the system controller 54 obtains the amount of movement of the PF motor 31 from its reference position based on the output pulses of the rotary encoder 13, and stores the amount of movement, namely, the feed amount of the print paper P (step S14).

Next, the system controller 54 makes the main-scan drive circuit 61 drive the CR motor 30 to move the carriage 28 from the first position to a predetermined position (hereinbelow, also referred to as a temporary position), and the carriage is positioned there (step S16). As shown in FIGS. 9(*a*) and 9(*b*), the first position is substantially at a center of a width of the print paper P. The predetermined position may be either on the upper stream side or the lower stream side in the main scanning direction with respect to the first position. In this embodiment, as shown in FIG. 9(*b*) and FIG. 9(*c*), the carriage 28 is moved toward the upper stream side and positioned there.

Then, the system controller 54 controls the reflective optical sensor 29 with the reflective optical sensor control circuit 65, and receives the reflected light of the light emitted from the light emitting section 38 with the light receiving section 40, and measures the intensity of the electric signal, which is the output value, with the electric signal measuring section 66. Further, the system controller 54 compares the measured value with a predetermined threshold, and determines whether the target of the incident light is the print paper P or not (step S18). That is, the intensity of the reflected light differs for the case in which the target of the incident light is the print paper P and for the case in which it is not (namely, when the target is the platen 26) due to, for example, difference in color of the paper and the platen. Therefore, it becomes possible to determine whether or not the target of the incident light is the print paper P by comparing the output value of the light receiving sensor with the predetermined threshold, the output value corresponding to the intensity of the reflected light.

Next, if it is determined that the target of the incident light is the print paper P as a result of this determination, then the system controller 54 makes the main-scan drive circuit 61 drive the CR motor 30 to move the carriage 28 from the temporary position to a predetermined position (hereinbelow, also referred to as a second position) located on the side opposite from the temporary position with respect to the first position, and the carriage is positioned there (step S20). On the contrary, if it is determined that the target of the incident light is not the print paper P, then the system controller 54 moves the carriage 28 from the temporary position to a predetermined position that is located on the same side as the temporary position with respect to the first position and that is also referred to as the second position, and the carriage is positioned there (step S22). Then, based on the output pulses of the linear encoder 11, the amount of movement of the CR motor 30 from its reference position is obtained, and the amount of movement, that is, the second position of the carriage 28 is recorded (step S24).

Note that, when it is determined that the target of the incident light is not the print paper P, the temporary position may be regarded as the second position, without moving the carriage 28 from the temporary position to the second position.

In this embodiment, since it is determined that the target of the incident light is the print paper P as shown in FIG. 9(*c*), the system controller 54 moves the carriage 28 from the temporary position to the predetermined position (hereinbelow, referred to also as the second position) located on the side opposite from the temporary position with respect to the first position, and the carriage is positioned there as shown in FIG. 9(*c*) and FIG. 9(*d*) (step S20).

Further, as shown in FIG. 9(*d*) and FIG. 9(*e*), when the print paper P is further fed by the paper feed motor 31, then, as shown in FIG. 9(*e*), the top edge of the print paper P blocks the light emitted from the light emitting section 38 (step S26). At this time, the target of the incident light emitted from the light emitting section 38 changes from the platen 26 to the print paper P, and therefore, the intensity of the electric signal which is the output value of the light receiving section 40 of the reflective optical sensor 29, which received the reflected light, changes. The intensity of this electric signal is measured by the electric signal measuring section 66, and it is detected that the top edge of the print paper P has passed the light.

Further, at this time, the system controller 54 obtains the amount of movement of the PF motor 31 from its reference position based on the output pulses of the rotary encoder 13, and this amount of movement, namely, the feed amount of the print paper P is stored (step S28).

Next, the system controller 54 obtains the skew of the print paper P based on the first position of the carriage 28 stored in step S8, the second position of the carriage 28 stored in step S24, the feed amount of the print paper P stored in step S14, and the feed amount of the print paper P stored in step S28.

Figure 11:
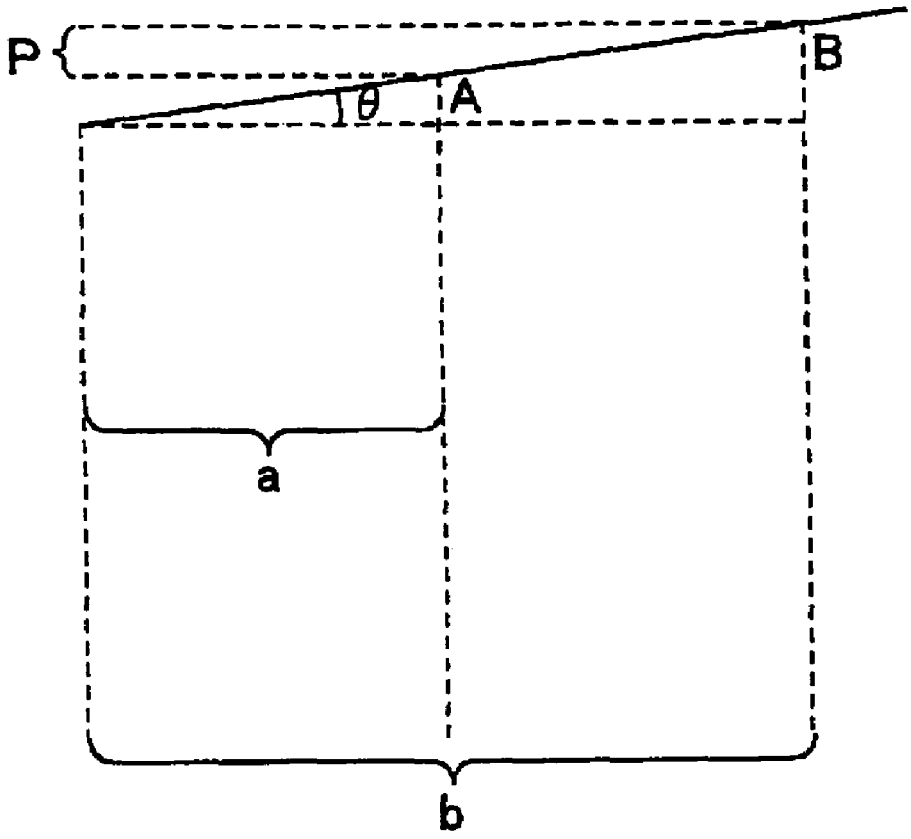
FIG. 11 is a diagram for illustrating an example of a method for obtaining the skew of the print paper P.

Using FIG. 11, a more detailed explanation is provided. FIG. 11 is a diagram for explaining an example of a method of obtaining the skew of the print paper P.

The solid straight line shown in the figure which is inclined toward the upper right direction indicates the top edge of the print paper P. Further, the left end of the line shown in the figure indicates the right end of the upper edge of the print paper P (hereinbelow, also referred to as the upper right edge), and the right end of the line indicates the left end of the upper edge of the print paper P. The reason why the right and left of the line and the right and left of the upper edge of the print paper P are reversed in position is because the paper feed direction is in the direction from the upper side to the lower side of the figure.

Further, as shown in the figure, the first position, which is stored in step S8, for when the first position of the carriage 28 is at point A is assumed to be numerical value a. Similarly, the second position, which is stored in step S24, for when the second position of the carriage 28 is at point B is assumed to be numerical value b. Note that, for convenience, both numerical values a and b are values that adopt the position, in the main scanning direction, of the upper right edge of the print paper P as a reference position; this, however, is not a limitation, and other positions may be adopted.

Further, as regards the paper feed direction, the difference p between the positions of point A and point B in the figure directly indicates the difference between the feed amount of the print paper P stored in step S14 and the feed amount of the print paper P stored in step S28, because the carriage moves only in the main scanning direction. Therefore, it becomes possible to obtain the difference p from the numerical values stored in step S14 and step S28.

Next, the skew of the print paper P is obtained from numerical values a, b, and p. As shown in the drawings, the skew is indicated by, for example, angle θ between the main scanning direction and the line. As is clear from the figure, the following relationship holds true:

$$\text{Angle } \theta = \tan-1(p/(b-a))$$

In this way, the skew of the print paper P can be obtained from the numerical values stored in steps S8, S14, S24, and S28 (step S30).

Next, as shown in FIG. 9(*e*) and FIG. 9(*f*), the system controller 54 makes the main-scan drive circuit 61 drive the CR motor 30 to move the carriage 28. As shown in FIG. 9(*f*), the edge of the print paper P will pass across the light emitted from the light emitting section 38 (step S32). At this time, the target of the incident light emitted from the light emitting section 38 changes from the print paper P to the platen 26, and therefore, the intensity of the electric signal which is an output value of the light receiving section 40 of the reflective optical sensor 29, which received the reflected light, changes. Then, the intensity of the electric signal is measured by the electric signal measuring section 66, and it is detected that the edge of the print paper P has passed the light.

Then, the amount of movement of the CR motor 30 from its reference position is obtained based on the output pulses of the linear encoder 11, and this amount of movement, namely, the position of the carriage 28 (hereinbelow, referred to also as a third position) is stored (step S34).

Next, as shown in FIG. 9(*f*) and FIG. 9(*g*), in order to conduct borderless printing on the print paper P, the system controller 54 drives the CR motor 30 and further moves the carriage 28.

Then, as shown in FIG. 9(*g*) and FIG. 9(*h*), the carriage 28 is moved in the main scanning direction and ink is ejected from the print head 36 to conduct borderless printing (step S38).

Figure 12:
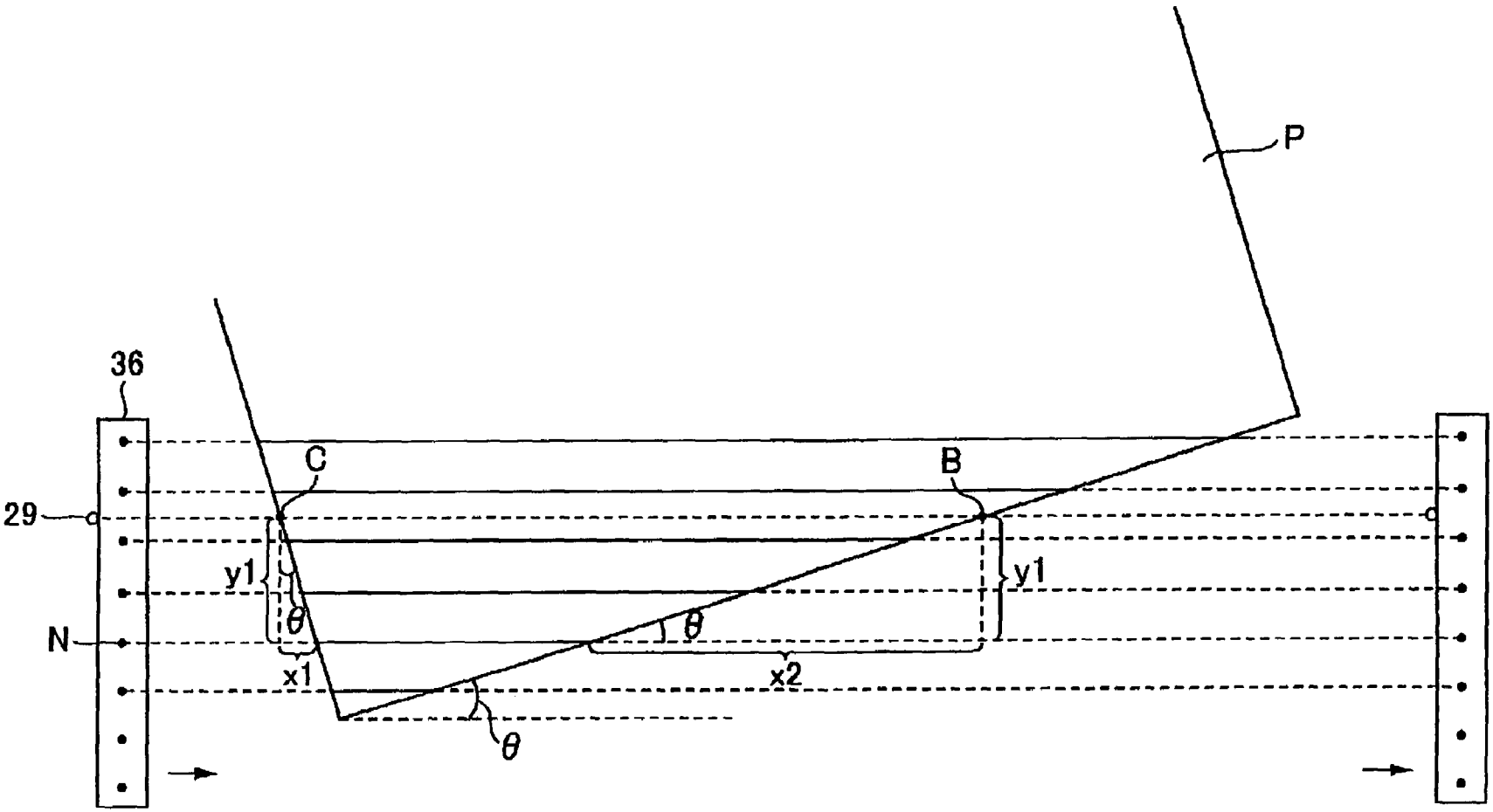
FIG. 12 is an explanatory diagram of positions at which ink ejection is started and ended.

Below, the positions at which ink ejection is started and ended are explained using FIG. 12. FIG. 12 is an explanatory diagram of positions at which ink ejection is started and ended.

The positional relationship between the print head 36, the reflective optical sensor 29, and the print paper P in FIG. 12 corresponds to that in FIG. 9(*h*). Ink is ejected from the nozzles of the print head 36 while the print head 36, which is shown in the left side of the figure, is moved in the main scanning direction to perform printing on the print paper P, and eventually, the print head 36 reaches the position shown in the right side of the figure. Each of the six lines drawn on the print paper P shows the assembly of dots formed when ink is ejected from each of the nozzles of the print head 36. The arrangement of the nozzles is as already explained with reference to FIG. 8; for better understanding, however, an example in which the print head is structured by a one-array nozzle group and provided with only eight nozzles is shown in FIG. 12.

The present embodiment explains a method for determining the positions at which ink ejection from a nozzle N shown in the figure, among the eight nozzles, is started and ended; the determination, however, may be made for the other nozzles in a similar way.

First, the lower left portion of the print paper P shown in FIG. 12 is paid attention to. As shown in the figure, it is assumed that a distance, in the paper feed direction, between the reflective optical sensor 29 and the nozzle N is y1, the skew of the print paper P is angle θ, and a distance, in the main scanning direction, between the third position C and a point at the edge of the print paper P where the nozzle N of the print head 36, which moves in the main scanning direction, passes is x1. In this case, the following relationship holds true: x1=y1×tan θ. Since the distance y1 is known, the distance x1 can be obtained by substituting the skew of the print paper P, which has been obtained in step S30, for the angle θ.

Similarly, the central lower portion of the print paper P shown in FIG. 12 is paid attention to. As shown in the figure, it is assumed that the distance, in the paper feed direction, between the reflective optical sensor 29 and the nozzle N is y1, the skew of the print paper P is angle θ, and a distance, in the main scanning direction, between the second position B and a point at the edge of the print paper P where the nozzle N of the print head 36, which moves in the main scanning direction, passes for the second time is x2. In this case, the following relationship holds true: x2=y1/tan θ. Since the distance y1 is known, the distance x2 can be obtained by substituting the skew of the print paper P, which has been obtained in step S30, for angle θ.

In this way, the position at which ink ejection from the nozzle N is to be started can be determined based on the third position C in the main scanning direction stored in step S34 and the distance x1, and also, the position at which ink ejection from the nozzle N is to be ended can be determined based on the second position B in the main scanning direction stored in step S24 and the distance x2 (step S36).

That is, the system controller 54 controls the main-scan drive circuit 61 to move the CR motor 30 in the main scanning direction and also controls the head drive circuit 63 to drive the print head 36 in order so that ink ejection from the nozzle N is started at a point that is delayed in position from the third position C by the distance x1 and so that ink ejection from the nozzle N is ended at a point that precedes the second position B by the distance x2 (step S38).

Further, due to the movement in the main scanning direction of the carriage 28 from FIG. 9(*g*) through FIG. 9(*h*), the light emitted from the light emitting section 38 of the reflective optical sensor 29 will pass across the edges of the print paper P. That is, this situation will occur when the positional relationship between the print paper P and the reflective optical sensor 29 is in the relationship shown in FIG. 9(*f*) and FIG. 9(*e*). At this time, as described above, the intensity of the electric signal which is the output value of the light receiving section 40 of the reflective optical sensor 29, which received the reflected light, changes. Then, the intensity of the electric signal is measured by the electric signal measuring section 66, and it is detected that the edge of the print paper P has passed the light (step S38).

Then, based on the output pulses of the linear encoder 11, the amount of movement of the CR motor 30 from its reference position is obtained, and this amount of movement, namely, the positions of the carriage 28 (the position of the carriage 28 corresponding to FIG. 9(*f*) is also referred to as a fourth position, and a position of the carriage 28 corresponding to FIG. 9(*e*) is also referred to as a fifth position below) are stored (step S40).

Next, as shown in FIG. 9(*h*) and FIG. 9(*i*), the system controller 54 drives the CR motor 30 to move the carriage 28, drives the paper feed motor 31 to feed the print paper P for a predetermined amount, and prepares for the next borderless printing (step S42). Note that, at this time, the system controller 54 obtains the amount of movement of the PF motor 31 from its reference position based on the output pulses of the rotary encoder 13, and this amount of movement, namely, the feed amount of the print paper P is stored (step S44).

Then, as shown in FIG. 9(*i*) and FIG. 9(*j*), the carriage 28 is moved in the main scanning direction and ink is ejected from the print head 36 to conduct borderless printing (step S48).

Figure 13:
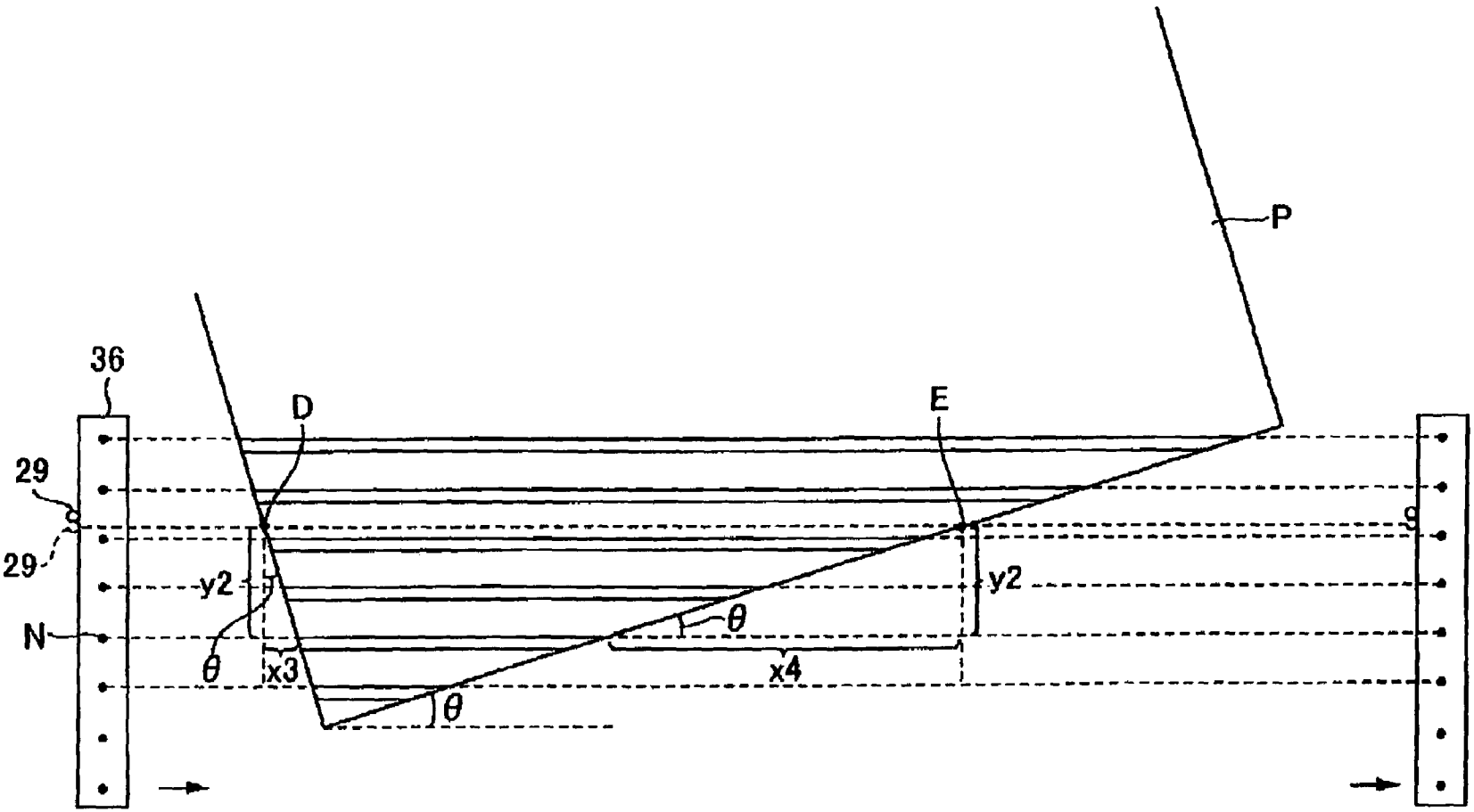
FIG. 13 is an explanatory diagram of positions at which ink ejection is started and ended.

Below, the positions at which ink ejection is started and ended are explained using FIG. 13. FIG. 13 is an explanatory diagram of positions at which ink ejection is started and ended.

The positional relationship of the print head 36, the reflective optical sensor 29, and the print paper P in FIG. 13 corresponds to that of FIG. 9(*j*). Ink is ejected from the nozzles of the print head 36 while the print head 36, which is shown in the left side of the figure, is moved in the main scanning direction to perform printing on the print paper P, and eventually, the print head 36 reaches the position shown in the right side of the figure. Each of the twelve lines drawn on the print paper P shows the assembly of dots formed by ejecting ink from each of the nozzles of the print head 36. Among these lines, the even-number lines counted from the top of the figure are lines that were formed in step S38, and the odd-number lines are lines that are formed during the present step.

Further, in this figure, two reflective optical sensors 29 are shown; the lower reflective optical sensor 29 shown in dotted lines, however, is depicted only to show the relative position between the reflective optical sensor 29 and the print paper P before the print paper P is fed for a predetermined amount. Therefore, it is appreciated from the figure that the position, in the paper feed direction, of the lower reflective optical sensor 29 shown in dotted lines coincides with the positions, in the paper feed direction, of the fourth position D and the fifth position E, which have already been explained above.

The arrangement of the nozzles is as already explained using FIG. 8; for better understanding, however, an example in which the print head is structured by a one-array nozzle group and provided with only eight nozzles is shown in FIG. 13.

The present embodiment explains a method for determining the positions at which ink ejection from the nozzle N shown in the figure, among the eight nozzles, is started and ended; the determination, however, may be made for the other nozzles in a similar way.

First, the lower left portion of the print paper P shown in FIG. 13 is paid attention to. As shown in the figure, it is assumed that a distance, in the paper feed direction, between the lower reflective optical sensor 29 shown in dotted lines and the nozzle N is y2, the skew of the print paper P is angle θ, and a distance, in the main scanning direction, between the fourth position D and a point at the edge of the print paper P where the nozzle N of the print head 36, which moves in the main scanning direction, passes is x3. In this case, the following relationship holds true: $x3=y2\times\tan\theta$. Since the distance y2 is equal to a value obtained by subtracting the predetermined paper feed amount of the print paper P, which has already been explained, from the above-mentioned distance y1 that is known, the distance x3 can be obtained by substituting the skew of the print paper P, which has been obtained in step S30, for the angle θ. It should be noted that the above-mentioned predetermined paper feed amount can be obtained according to the difference between the numerical values stored in step S28 and step S44.

Similarly, the central lower portion of the print paper P shown in FIG. 13 is paid attention to. As shown in the figure, it is assumed that the distance, in the paper feed direction, between the lower reflective optical sensor 29 shown in dotted lines and the nozzle N is y2, the skew of the print paper P is angle θ, and a distance, in the main scanning direction, between the fifth position E and a point at the edge of the print paper P where the nozzle N of the print head 36, which moves in the main scanning direction, passes for the second time is x4. In this case, the following relationship holds true: $x4=y2/\tan\theta$. Since the distance y2 is equal to the value obtained by subtracting the predetermined paper feed amount of the print paper P, which has already been explained, from the above-mentioned distance y1 that is known, the distance x4 can be obtained by substituting the skew of the print paper P, which has been obtained in step S30, for angle θ.

In this way, the position at which ink ejection from the nozzle N is to be started can be determined based on the fourth position D in the main scanning direction stored in step S40 and the distance x3, and also, the position at which ink ejection from the nozzle N is to be ended can be determined based on the fifth position E in the main scanning direction stored in step S40 and the distance x4 (step S46).

That is, the system controller 54 controls the main-scan drive circuit 61 to move the CR motor 30 in the main scanning direction and also controls the head drive circuit 63 to drive the print head 36 in order so that ink ejection from the nozzle N is started at a point that is delayed in position from the fourth position D by the distance x3 and so that ink ejection from the nozzle N is ended at a point that precedes the fifth position E by the distance x4 (step S48).

Further, due to the movement in the main scanning direction of the carriage 28 from FIG. 9(*i*) through FIG. 9(*j*), the light emitted from the light emitting section 38 of the reflective optical sensor 29 will pass across the edges of the print paper P. At this time, as described above, the intensity of the electric signal which is the output value of the light receiving section 40 of the reflective optical sensor 29, which received the reflected light, changes. Then, the intensity of the electric signal is measured by the electric signal measuring section 66, and it is detected that the edge of the print paper P has passed the light (step S48).

Then, based on the output pulses of the linear encoder 11, the amount of movement of the CR motor 30 from its reference position is obtained, and this amount of movement, namely, the positions of the carriage 28 are stored (step S50).

Next, the system controller 54 makes the CR motor 30 drive to move the carriage 28, makes the paper feed motor 31 drive to feed the print paper P for the predetermined amount, and prepares for the next borderless printing. The following procedures are the same as those already described. The positions at which ink ejection is started and ended are determined for each nozzle of the print head 36 based on the positions of the carriage 28 stored in step S50 and the above-mentioned predetermined amount, and borderless printing on the print paper P is conducted based on the determination. Then, by repeating these procedures, borderless printing is completed.

Note that, a program for executing the above processes is stored in the EEPROM 58, and the program is executed by the system controller 54.

As explained in the section of the Background Art, in the method in which print data is prepared slightly larger than the print paper, that is, prepared with a certain amount of margin compared to the size of the print paper and printing is performed on the print paper based on this print data taking into consideration situations in which the print paper is supplied in a skewed (slanted) manner, there is a possibility that printing will be conducted on a region other than the print paper, and there may arise a problem that ink is uselessly consumed.

In view of the above, it becomes possible to solve the above-mentioned problem by decreasing the ink consumption amount by detecting the top edge of the print paper P at a plurality of points to obtain the skew of the print paper P, and changing the starting position or the ending position, or both positions, for ejecting ink from the print head 36, which moves in the main scanning direction, according to the skew that has been obtained.

Note that, in the description above, the amounts of movement of the PF motor 31 from its reference position were obtained and these amounts of movement were stored as the feed amounts of the print paper P in step S14 and step S28, and the difference in the feed amounts was regarded as the amount of the print paper fed from when the change in the output value of the light receiving sensor was detected at the first position until when the change in the output value of the light receiving sensor was detected at the second position. The feed amount of the print paper, however, may be obtained by using the position of the PF motor 31 in step S14 as the reference position for obtaining the amount of movement of the PF motor 21 in step S28. Further, the same may apply for the procedure described above for obtaining a predetermined paper feed amount from the difference between the numerical values stored in step S28 and step S44, and for the procedure described above for obtaining the distance in the main scanning direction from the difference between the numerical values stored in step S8 and step S24.

Further, in the above, the first position, the temporary position, and the second position were regarded as the predetermined positions; the predetermined positions, however, may be at any position. Further, when the first position and the second position are regarded as the predetermined positions, the procedures performed later on for storing the first position and the second position, that is, steps S8 and S24 may be omitted.

Further, in step S38, ejection of ink from the nozzle N is started at a point that is delayed in position from the third position C by the distance x1, and ejection of ink from the nozzle N is ended at a point that precedes the second position B by the distance x2. It is possible, however, to start ejection of ink from the nozzle N at a point that is delayed in position by a distance (x1−Δ1) which is smaller than the distance x1, and to end ejection of ink from the nozzle N at a point that is preceding in position by a distance (x2−Δ2) which is smaller than the distance x2 to provide a certain amount of margin. Further, in a similar manner, it is possible, in step S48, to start ejection of ink from the nozzle N at a point that is delayed in position by a distance (x3−Δ3) which is smaller than the distance x3, and to end ejection of ink from the nozzle N at a point that is preceding in position by a distance (x4−Δ4) which is smaller than the distance x4.

OTHER EMBODIMENTS

A printing apparatus etc. according to the present invention was described above according to an embodiment thereof. The foregoing embodiment of the invention, however, is for the purpose of facilitating understanding of the present invention and is not to be interpreted as limiting the present invention. The invention can of course be altered and improved without departing from the gist thereof and includes equivalents thereof.

Further, print paper was described as an example of a printing medium, but a film, a cloth, a thin metal plate, and the like may be used as a printing medium.

Further, it is possible to provide a computer system that has a computer body, a display device which is connectable to the computer body, and a printer according to the above described embodiment which is connectable to the computer body, and an input device such as a mouse or a keyboard, a flexible disk drive device, and a CD-ROM drive device that are provided if necessary. A computer system configured in this way will be superior to conventional computer systems as a whole.

The printer according to the above-described embodiment may have some of the functions or the mechanisms of each of the computer body, the display device, the input device, the flexible disk drive device, and the CD-ROM drive device. For example, the printer may have a structure comprising an image processing section for performing image processing, a display section for performing various displays, and a recording media mounting section for mounting and dismounting a recording medium in which image data captured by a digital camera or the like are recorded.

Note that, the above embodiment describes a color inkjet printer, but the present invention may also be applied to a monochrome inkjet printer.

It should be noted that in the above-mentioned embodiment, printing was carried out on an entire surface of the print paper P, that is, so-called borderless printing was performed. This, however, is not a limitation, and the above-mentioned means has an advantageous effect for cases in which printing is not performed on the entire surface of the print paper P but performed on a large area.

The advantages brought about by the above-mentioned means, however, become more significant for borderless printing because printing is carried out on the end portions of the print paper.

Further, in the above-mentioned embodiment, the printing apparatus comprised a light emitting section 38 for emitting light, and a light receiving section 40 for receiving the light that moves in the main scanning direction according to the movement of the light emitting section 38 in the main scanning direction, and the skew of the print paper P was obtained by detecting, for a plurality of times by changing the position of the light emitting section 38, a change in an output value of the light receiving section 40 that occurs when the top edge blocks the light emitted by the light emitting section 38 that has been positioned. This, however, is not a limitation.

The above-mentioned embodiment, however, is more preferable in terms that, in this way, it is possible to easily determine the position of the top edge.

Further, in the above-mentioned embodiment, the change in the output value of the light receiving section 40 that occurs when the top edge of the print paper P blocks the light was detected at a first position and a second position that are in positions different from each other in the main scanning direction; and the skew of the print paper P was obtained based on a distance in the main scanning direction from the first position to the second position, and a feed amount of the printing medium from when the change in the output value was detected at the first position until when the change in the output value was detected at the second position. This, however, is not a limitation.

The above-mentioned embodiment, however, is more preferable in terms that, in this way, the number of times for detecting the changes in the output value of the light receiving sensor can be kept at a minimum, and the procedure can be simplified.

Further, in the above-mentioned embodiment, the change in the output value of the light receiving section 40 that occurs when the light emitted by the light emitting section 38 passes across an edge of the print paper P was detected to determine the position of the edge of the print paper P by making the print paper P stand still and making the light emitting section 38 move in the main scanning direction; and the starting position, the ending position, or both of these for ejecting ink from the print head 36, which moves in the main scanning direction, was changed according to the skew and the position of the edge. This, however, is not a limitation, and it is also possible, for example, to change the starting position, the ending position, or both of these for ejecting ink from the print head 36, which moves in the main scanning direction, according to the skew only.

The above-mentioned embodiment, however, is more preferable in terms that, in this way, information for determining an appropriate starting position or an ending position for ejecting ink from the print head 36, which moves in the main scanning direction, increases, and therefore, an appropriate starting position or ending position can be precisely determined.

Further, in the above-mentioned embodiment, the change in the output value of the light receiving section 40 that occurs when the light emitted by the light emitting section 38 passes across the edge of the print paper P was detected twice to determine each position of two edges; and the starting position, the ending position, or both of these was changed according to the skew and the positions of the two edges. This, however, is not a limitation, and it is also possible, for example, to change the starting position, the ending position, or both of these for ejecting ink from the print head 36, which moves in the main scanning direction, according to the skew and the position of only one edge of the above-mentioned two edges.

The above-mentioned embodiment, however, is more preferable in terms that, in this way, information for determining an appropriate starting position or an ending position for ejecting ink from the print head 36, which moves in the main scanning direction, increases, and therefore, an appropriate starting position or ending position can be determined precisely.

Further, in the above-mentioned embodiment, the light emitting section 38 and the light receiving section 40 were provided on a carriage 28 that is provided with the print head 36 and that is movable in the main scanning direction. This, however, is not a limitation, and it is possible, for example, to adopt a structure in which the carriage 28, the light emitting section 38, and the light receiving section 40 can move separately in the main scanning direction.

The above-mentioned embodiment, however, is more preferable in terms that, in this way, the moving mechanism for the carriage 28, the light emitting section 38, and the light receiving section 40 can be shared.

Further, in the above-mentioned embodiment, after detecting the change in the output value of the light receiving section 40 that occurs when the light emitted by the light emitting section 38 passes across the edge of the print paper P by making the carriage 28 move in the main scanning direction (step S38), the starting position, the ending position, or both of these for ejecting ink from the print head 36, which moves in the main scanning direction, for when the carriage 28 is made to move again in the main scanning direction was changed according to the above-mentioned detection (step S48), as described in step S38 through step S48. This, however, is not a limitation, and it is also possible, for example, to detect the change in the output value of the light receiving section 40 and to change the starting position, the ending position, or both of these for ejecting ink from the print head 36, which moves in the main scanning direction, according to the above-mentioned detection while the carriage 28 moves in the main scanning direction once.

In the latter method, however, there are situations in which some of the nozzles of the print head 36 have already passed across the edge of the print paper P when the change in the output value of the light receiving section 40 is detected. Therefore, it would be necessary to take measures such as to start ink ejection from these nozzles in beforehand, regardless of whether or not the detection has been made. On the other hand, the method according to the present embodiment is more preferable in terms that it does not involve such an inconvenience.

Further, in the above-mentioned embodiment, after detection of the change in the output value at the first position, the light emitting section 38 and the light receiving section 40 were moved from the first position either towards the upper stream side or the lower stream side in the main scanning direction, and when it was determined that the light is incident on the print paper P based on the output value of the light receiving section 40 that has received the light emitted by the light emitting section 38, then the second position was set on the side opposite from the side where the determination was made with respect to the first position, whereas when it was determined that the light is not incident on the print paper P, then the second position was set on the same side as the side where the determination was made with respect to the first position. This, however, is not a limitation, and it is also possible, for example, to omit these procedures upon setting the second position.

If, however, the second position is set, without carrying out the above-mentioned procedures, on the side where the target of incidence would be on the print paper if the light were emitted, then it would be necessary to feed the print paper backwards in order for the top edge of the print paper to block the light at the second position. The present embodiment is therefore more preferable in terms that it is possible to avoid such an inconvenience.

Further, in the above description, the change in the output value of the light receiving section 40 that occurs when the light emitted by the light emitting section 38 passes across an edge of the print paper P was detected to find the position of the above-mentioned edge by making the print paper P stand still and making the light emitting section 38 move in the main scanning direction; and the starting position, the ending position, or both of these for ejecting ink from the print head, which moves in the main scanning direction, was changed according to the skew that has been obtained and the position of the edge. The position of the above-mentioned edge, which is the information used for determining an appropriate starting position or ending position, however, does not necessarily have to be the position that was found right before the determination.

INDUSTRIAL APPLICABILITY

With the present invention, it is possible to provide a printing apparatus, a printing method, a computer program, and a computer system, which decrease ink consumption amount.

The invention claimed is:

1. A printing apparatus for carrying out printing on a printing medium comprising:

a print head that is movable in a main scanning direction and that is for ejecting ink onto said printing medium;

a printing medium feeding section for feeding said printing medium;

a sensor that detects said printing medium, said sensor being movable in the main scanning direction; and a controller (a) operative to position said sensor in a first position that is at substantially a center of a width of said printing medium in the main scanning direction, (b) operative to feed said printing medium with said printing medium feeding section, (c) operative to detect at said first position a leading edge of said printing medium with said sensor, (d) operative to move said sensor to a temporary position different from said first position, (e) when said printing medium has not been detected with said sensor at said temporary position, said controller considers a predetermined position being at a same side as said temporary position with respect to said first position, and when said printing medium has been detected with said sensor at said temporary position, said controller is operative to move said sensor to a second position that is a position at an opposite side to said temporary position with respect to said first position, said printing medium not being detected with said sensor at said second position, (f) operative to feed said printing medium with said printing medium feeding section, (g) operative to detect at said second position said leading edge of said printing medium with said sensor, (h) operative to obtain a skew of said printing medium by performing a calculation using numerical values that are based on detection results of said leading edge at said first position and said second position, and (i) operative to change at least one of a starting position, an ending position, and both of these for ejecting ink form said print head, which moves in the main scanning direction, according to said skew that has been obtained.

2. A printing method conducted by a printing apparatus for carrying out printing on a printing medium, said printing apparatus including a print head that is movable in a main scanning direction and that is for ejecting ink onto said printing medium, printing medium feeding section for feeding said printing medium, a sensor that can detect said printing medium, said sensor being movable in the main scanning direction, wherein said printing method comprises:

(a) positioning said sensor in a first position that is at substantially a center of width of said printing medium in the main scanning direction;

(b) feeding said printing medium with said printing medium feeding section;

(c) detecting at said first position a leading edge of said printing medium with said sensor;

(d) moving said sensor to a temporary position different from said first position;

(e) when said printing medium has not been detected with said sensor at said temporary position, considering a predetermined position as a second position, said predetermined position being at a same side as said temporary position with respect to said first position, and when said printing medium has been detected with said sensor at said temporary position, moving said sensor to a second position that is a position at an opposite side to said temporary position with respect to said first position, said printing medium not being detected with said sensor at said second position, (f) feeding said printing medium with said printing medium feeding section;

(g) detecting at said second position said leading edge of said printing medium with said sensor;

(h) obtaining a skew of said printing medium by performing a calculation using numerical values that are based on detection results of said leading edge at said first position and said second position; and (i) changing at least one of a starting position, an ending position, and both of these for ejecting ink from said print head, which moves in the main scanning direction, according to said skew that has been obtained.

* * * * *